US011608956B2

(12) United States Patent
Qiu et al.

(10) Patent No.: US 11,608,956 B2
(45) Date of Patent: Mar. 21, 2023

(54) LOW-BEAM ZONE III LIGHTING MODULE, VEHICLE HEADLAMP AND VEHICLE

(71) Applicant: HASCO VISION TECHNOLOGY CO., LTD., Shanghai (CN)

(72) Inventors: Zhiping Qiu, Shanghai (CN); He Zhu, Shanghai (CN)

(73) Assignee: HASCO VISION TECHNOLOGY CO., LTD., Shanghai (CN)

( * ) Notice: Subject to any disclaimer, the term of this patent is extended or adjusted under 35 U.S.C. 154(b) by 99 days.

(21) Appl. No.: 17/271,837

(22) PCT Filed: Oct. 11, 2019

(86) PCT No.: PCT/CN2019/110504
§ 371 (c)(1),
(2) Date: Feb. 26, 2021

(87) PCT Pub. No.: WO2020/244109
PCT Pub. Date: Dec. 10, 2020

(65) Prior Publication Data

US 2021/0317966 A1 Oct. 14, 2021

(30) Foreign Application Priority Data

Jun. 4, 2019 (CN) ..... 201910482729.X

(51) Int. Cl.
*F21S 41/365* (2018.01)
*F21S 41/255* (2018.01)
*F21W 102/13* (2018.01)

(52) U.S. Cl.
CPC ..... *F21S 41/365* (2018.01); *F21S 41/255* (2018.01); *F21W 2102/13* (2018.01)

(58) Field of Classification Search
CPC ..... F21S 41/365; F21S 41/255
(Continued)

(56) References Cited

U.S. PATENT DOCUMENTS 6,811,289 B2 * 11/2004 Nakata ..... F21S 41/335 362/299
2002/0089853 A1 * 7/2002 Taniuchi ..... F21S 41/43 362/346

(Continued)

FOREIGN PATENT DOCUMENTS

CN 102367939 A 3/2012
CN 205640631 U 4/2016

(Continued)

OTHER PUBLICATIONS

GB 25991-2010, National Standard of the People's Republic of China, Automotive Headlamps With LED Light Sources and/or LED Modules (2011).

(Continued)

*Primary Examiner* — Bryon T Gyllstrom
(74) *Attorney, Agent, or Firm* — Volpe Koenig

(57) ABSTRACT

A low-beam zone III lighting module including a light source, lens, transparent optical element and low-beam zone III formation mechanism are herein. The light source, the formation mechanism, the optical element and the lens are sequentially arranged along a light shape formation light path. The formation mechanism includes one first mirror and one second mirror. The first mirror and the second mirror are on two sides of an optical axis of the lens, and are staggered. The light source is at a first focal point of the first mirror and a second focal point of the first mirror coincides with a first focal point of the second mirror. A second focal point of the second mirror is on a light incident face of the transparent optical element. The lens is directly in front of a light-emitting face of the transparent optical element. A headlamp and vehicle are also herein.

19 Claims, 6 Drawing Sheets

(58) Field of Classification Search
USPC ..... 362/520
See application file for complete search history.

(56) References Cited

U.S. PATENT DOCUMENTS

| | | | | |
|---|---|---|---|---|
| 2005/0248956 | A1* | 11/2005 | Iwasaki | F21S 41/365 362/346 |
| 2006/0007544 | A1* | 1/2006 | Suzuki | F21V 9/04 359/533 |
| 2006/0262552 | A1* | 11/2006 | Komatsu | F21S 41/255 362/346 |
| 2007/0069580 | A1* | 3/2007 | Ohshio | F21S 41/365 307/10.8 |
| 2007/0247865 | A1* | 10/2007 | Kinoshita | F21S 41/255 362/538 |
| 2007/0263402 | A1* | 11/2007 | de Lamberterie | F21S 41/255 362/509 |
| 2010/0110715 | A1* | 5/2010 | Nakada | F21S 41/255 362/538 |
| 2011/0261576 | A1 | 10/2011 | Uchida | |
| 2015/0338047 | A1* | 11/2015 | Honda | F21S 41/255 362/517 |
| 2019/0126808 | A1* | 5/2019 | Matsumoto | F21S 41/255 |

FOREIGN PATENT DOCUMENTS

| | | | |
|---|---|---|---|
| CN | 106122870 | B | 11/2016 |
| CN | 206268977 | U | 6/2017 |
| CN | 109282234 | A | 1/2019 |
| CN | 109539168 | A | 3/2019 |
| CN | 109724047 | A | 5/2019 |
| GN | 208475225 | U | 2/2019 |
| GN | 110107857 | A | 8/2019 |
| GN | 209688732 | U | 11/2019 |

OTHER PUBLICATIONS

GB/T 30036-2013, National Standard of the People's Republic of China, Adaptive Front Lighting System for Motor Vehicles (2013).

* cited by examiner

LOW-BEAM ZONE III LIGHTING MODULE, VEHICLE HEADLAMP AND VEHICLE

The application is a 35 U.S.C. § 371 national stage of PCT/CN2019/110504, which was filed Oct. 11, 2019 and claims priority to CN 201910482729.X, filed Jun. 4 2019, both of which are incorporated herein by reference as if fully set forth.

FIELD OF THE INVENTION

The present disclosure relates to a vehicle lamp lighting module, in particular to a low-beam zone III lighting module, a vehicle headlamp and a vehicle.

BACKGROUND OF THE INVENTION

In the technical field of headlights, compared with traditional optical elements only provided with surface aluminized reflectors, optical elements made of transparent materials, especially optical elements made of transparent materials and provided with a certain length of light channels, have been increasingly used in low-beam or high-beam vehicle headlamp lighting devices in recent years. Due to the comprehensive advantages such as high light efficiency, simple system configuration and low system cost, the optical elements made of the transparent materials are gradually and increasingly applied to the low-beam or high-beam vehicle headlamp lighting devices, and a development trend of a headlight lighting device technology is formed. Low beams of headlights are used for close-range lighting. According to the relevant standards for headlights (take the Chinese standard GB25991 as an example), it is known that a low-beam light shape is provided with an important part called "zone III" which is located above a cut-off line and mainly used for illuminating objects such as signs above the road surface, and thus drivers can obtain information such as the signs.

For headlights requiring an adaptive front-lighting system (AFS) function, a zone III light shape which is narrow in the left-right direction (such as +/−10 degrees) cannot meet the standard requirements and the practical application requirement. An AFS can continuously adjust headlights dynamically according to the vehicle steering wheel angle, vehicle deflection rate and traveling speed so as to adapt to the current steering angle and keep the light direction consistent with the current traveling direction of a vehicle, thus, best lighting on the road ahead is ensured, the best visibility to drivers is provided, and therefore the safety of driving in the dark is significantly enhanced; and in poor road lighting or multi-curve road conditions, the visual field of the drivers is enlarged and the drivers can be reminded of opposite coming vehicles in advance. In the technical solution of a headlight realizing the AFS function, there is a way to realize the AFS function through left-right moving of a low-beam cut-off part light shape and stationary of a zone III light shape, then the zone III must be wide sufficiently in the left-right direction, this is because: (1) take Chinese AFS regulation GB T30036 as an example, there are two test positions of BLL and BRR in the zone III, BLL involves −8 degrees to −20 degrees on the left, and BRR involves+8 degrees to +20 degrees on the right, so that the zone III light shape needs to be at least ±20 degrees left and right; (2) when the vehicle rotates left and right, a low-beam cut-off part light shape of an AFS headlight will shift by a certain angle (for example, 10 degrees) in the corresponding turning direction, and the AFS regulations must also be met at this time, so if the zone III light shape does not shift, it is required that the zone III light pattern may cover a certain width (if the AFS rotates by 10 degrees, the zone III light shape needs to reach 30 degrees to meet the regulations); and (3) from the perspective of practical application, the zone III light shape also needs to have sufficient width for lighting with a sufficient width above a low-beam cut-off line, and sufficient lighting for zone III under the vehicle AFS function, and driver visibility of road information is improved.

In the prior art, a structure for forming a low-beam zone III of a low-beam lighting device adopting a transparent optical element with a light channel with a certain length is arranged as a corresponding zone III forming structure arranged on the optical element, but the width of the zone III light pattern still cannot be effectively increased. For example, the Chinese invention patent filed on Aug. 17, 2016 with the publication number being CN106122870B discloses an LED light source high-beam and low-beam integrated headlight module, the technical solution for forming a low-beam zone III is as follows: a secondary reflector is arranged, part of light reflected by the secondary reflector is reflected and refracted by a condenser (which is a transparent optical element) and then emitted from a lens, a low-beam zone III is formed, a zone III forming structure on the condenser is arranged on the upper portion of a condenser body and receives light reflected by a reflector arranged behind an LED light source, the light passes through the zone III forming structure, enters the lens after being emitted from a light emergent surface, and finally forms the zone III light shape, the left-right width of the formed zone III light shape is about ±10 degrees, the corresponding lighting requirements of the zone III when the vehicle turns cannot be met, and the requirements of the AFS regulations for the vehicle headlamp cannot be met.

Therefore, there is an urgent need in the technical field to provide a new technical solution for solving the technical problem that the left and right lighting angles of the zone III in the prior art are narrow.

SUMMARY OF THE INVENTION

The technical problem to be solved in the first aspect of the present disclosure is to provide a low-beam zone III lighting module, and the low-beam zone III lighting module can effectively expand the width of the zone III light shape.

The technical problem to be solved in the second aspect of the present disclosure is to provide a vehicle headlamp. The vehicle headlamp can not only effectively expand the width of a zone III light shape, but also meet the standard requirements and practical application needs for a self-adaptive front lighting system for a vehicle.

In addition, the technical problem to be solved in the third aspect of the present disclosure is to provide a vehicle, and when the vehicle turns, good zone III lighting within the turning range can still be achieved while a low-beam cut-off part shifts left and right and a zone III light shape does not shift.

In order to achieve the above objects, the first aspect of the present disclosure provides a low-beam zone III lighting module, and the low-beam zone III lighting module includes a light source and a lens, and further includes a transparent optical element and a low-beam zone III forming mechanism; the light source, the low-beam zone III forming mechanism, the transparent optical element and the lens are sequentially arranged along a low-beam zone III light shape forming optical path; and the low-beam zone III forming mechanism includes at least one first reflector and at least one second reflector, the first reflector and the second reflector are distributed on the two sides of an optical axis of the lens and arranged in a staggered manner, the light source is located at a first focal point of the first reflector, a second focal point of the first reflector and a first focal point of the second reflector coincide, a second focal point of the second reflector is arranged on a light incident surface of the transparent optical element, and the lens is located directly in front of a light emergent surface of the transparent optical element. Preferably, the transparent optical element includes the light incident surface, the light emergent surface, an upper surface and a lower surface, and the light incident surface, the upper surface, the lower surface and the light emergent surface define a light channel.

Further, the light incident surface is arranged as a flat surface or a concave or convex cambered surface, the upper surface is arranged as a flat surface or a concave or convex cambered surface, and the light emergent surface is arranged as a cambered surface with a concave middle and two convex ends.

More preferably, at least one of the light incident surface, the upper surface and the light emergent surface is provided with wrinkles.

Typically, the first reflector and the second reflector are configured to be ellipsoidal reflectors. Specifically preferably, the low-beam zone III forming mechanism includes one first reflector and one second reflector, the first reflector and the second reflector are respectively distributed on the two sides of the optical axis of the lens and arranged in a staggered manner, the light source is located at the first focal point of the first reflector, the second focal point of the first reflector coincides with the first focal point of the second reflector, the second focal point of the second reflector is arranged on the light incident surface of the transparent optical element, the lens is located directly in front of the light emergent surface of the transparent optical element, so as to enlarge the width of one side of the low-beam zone III light shape.

Specifically, the low-beam zone III forming mechanism includes two first reflectors and two second reflectors, the two first reflectors and the two second reflectors are symmetrically arranged on the two sides of the optical axis of the lens respectively, wherein the second focal point of the first reflector located on one side of the optical axis of the lens and the first focal point of the second reflector located on the other side of the optical axis of the lens coincide, the first focal points of the two first reflectors coincide, the light source is located at the first focal points of the first reflectors, the second focal point of each of the second reflectors is arranged on the light incident surface of the transparent optical element, the lens is located directly in front of the light emergent surface of the transparent optical element, so as to enlarge the widths of two sides of the low-beam zone III light shape.

Typically, the low-beam zone III lighting module further includes a low-beam reflector, and a first focal point of the low-beam reflector is arranged on the light source.

Typically, the low-beam zone III lighting module further includes a radiator, each of the first reflectors, each of the second reflectors and the low-beam reflector are mounted on the radiator or are integrally formed with the radiator.

A second aspect of the present disclosure provides a vehicle headlamp including the low-beam zone III lighting module according to any one of the technical solutions of the first aspect.

A third aspect of the present disclosure provides a vehicle including the vehicle headlamp according to the technical solutions of the second aspect.

Through the above technical solutions, the present disclosure has the following beneficial effects: In the basic technical solutions of the present disclosure, light emitted by the light source is sequentially reflected by the first reflector and the second reflector into the transparent optical element, and then emitted through the light emergent surface of the transparent optical element and the lens, since the first reflector and the second reflector are distributed on the two sides of the optical axis of the lens and arranged front and back in a staggered manner, compared with the prior art, the transmission direction of the light emitted through the lens is changed by a certain large angle in the left-right direction, so that the lighting range of the low-beam zone III light shape in the left-right direction is enlarged, that is, the width of the low-beam zone III light shape is increased.

Wherein, the light incident surface of the transparent optical element may be arranged as a flat surface or a concave or convex cambered surface, the cambered surface can diffuse light, and the upper surface may also be arranged as a flat surface or a concave or convex cambered surface which can reflect light incident from the light incident surface; especially, the light emergent surface of the transparent optical element is arranged as a cambered surface with a concave middle and two convex ends, so that the angle of outer side light emitted from the light emergent surface of the transparent optical element is more divergent, and a large-angle and wide-range low-beam zone III light shape is formed more advantageously.

In addition, at least one of the light incident surface, the upper surface and the light emergent surface of the transparent optical element may be provided with wrinkles, the wrinkles are configured to produce diffuse reflection of light, reduce the energy of light irradiated on the effective area and thus adjust the lighting intensity of a low-beam zone III so as to meet the regulatory requirements of headlights, and general regulations require that the maximum lighting intensity of the zone III is lower than 625 cd (candela), that is, 625 cd corresponds to 1 lx (lux) illumination on the 25 m light distribution screen.

Moreover, after applying the low-beam zone III lighting module of the present disclosure to a vehicle headlamp, especially an AFS headlight, when the vehicle turns, good zone III lighting within the turning range can still be achieved while a low-beam cut-off part shifts left and right and a zone III light shape does not shift.

Other advantages of the present disclosure and the technical effects of the preferred embodiments will be further described in the following specific embodiments.

BRIEF DESCRIPTION OF THE SYMBOLS

1. Light source,
2. Lens,
3. Transparent optical element,
31. Light incident surface,
32. Light emergent surface,
33. Upper surface,
34. Lower surface,
35. Light channel,
4. First reflector,
5. Second reflector,
6. Low-beam reflector,
001. Low-beam light shape,
002. Small angle zone III light shape,
003. Right large angle zone III light shape,
004. Left large angle zone III light shape.

DETAILED DESCRIPTION OF THE EMBODIMENTS

Embodiments of the present disclosure will be described in detail with reference to the accompanying drawings below. It should be understood that the embodiments described herein are only used to illustrate and explain the present disclosure, and are not intended to limit the present disclosure.

The terms "first" and "second" are used for descriptive purposes only, and cannot be understood as indicating or implying relative importance or implicitly indicating the number of technical features indicated. Therefore, features defined by "first" and "second" may include one or more of the features explicitly or implicitly.

In the description of the present disclosure, it should be noted that unless otherwise clearly specified and limited, the terms "installation" and "arrangement" should be understood in a broad sense, for example, it may be fixed connection, detachable connection, or integrated connection; it may be direct connection or indirect connection through an intermediate medium; it may be internal communication of two elements or the interaction between two elements. For those of ordinary skilled in the art, the specific meanings of the above terms in the present disclosure can be understood according to specific situations.

The technical solutions of the Chinese invention patent filed on Aug. 17, 2016 with the publication number being CN106122870B are not able to expand the width of the zone III light shape because the imaging angle range of the light corresponding to the zone III at the cut-off line structure needs to reach the corresponding width range if the width of the zone III light shape needs to be increased, otherwise a large width cannot be formed after projection through the lens, and the zone III light shape reflected by a secondary reflector in the above technical solution is emitted into the zone III forming structure on the condenser directly from the rear, so that the angle of incident light is limited to a certain small angle range, in addition, the zone III forming structure extends from back to front to the concave light emergent surface arranged at the focal point of the lens, the zone III light shape is basically focused on the middle position of the optical axis to transmit, the expandable angular range is limited, the left-and-right expansion of the light is further limited by the light emergent surface of the concave structure, light emitted into the lens cannot have a wider angular range, and the width of the formed zone III is narrow in the left-right direction.

Figure 2:
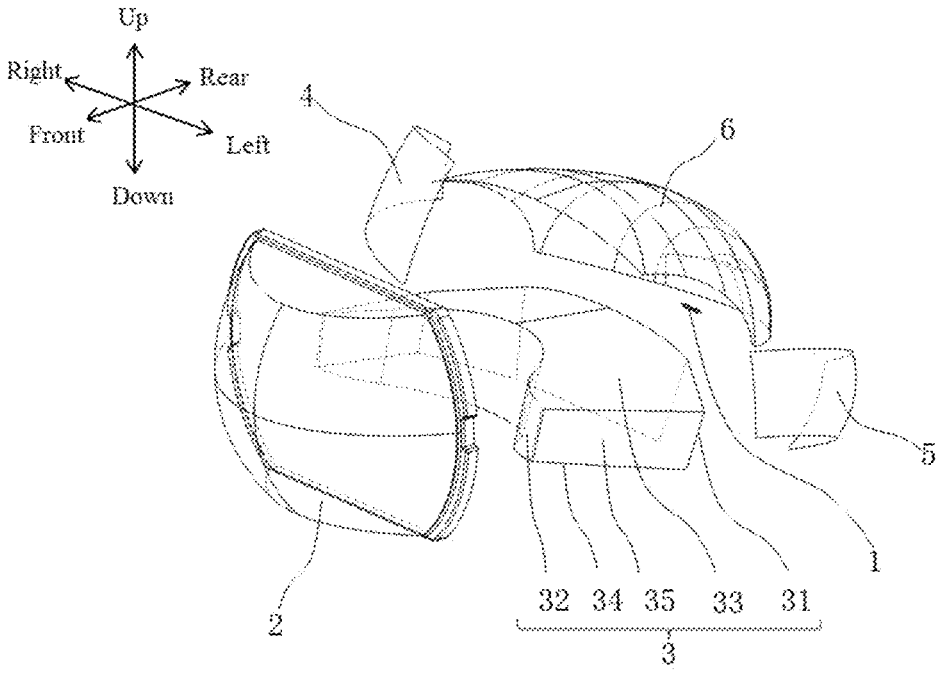
FIG. 2 is a schematic diagram of a three-dimensional structure of an embodiment of the present disclosure.

It should be firstly noted that to facilitate understanding, as shown in FIG. 2, based on the optical axis of the lens 2, the light emergent end represents "front", the light incident end represents "rear", the left side in the light emergent direction represents "left", the right side in the light emergent direction represents "right", the upper part in the light emergent direction represents "up", and the lower part in the light emergent direction represents "down". It should be understood that the terms are based on the orientation or position relationship shown as accompanying drawings, are only for the convenience of describing the present disclosure and simplifying the description, and do not indicate or imply that devices or elements referred to must have a specific orientation, and be constructed and operated in a specific orientation, and therefore cannot be understood as a limitation to the present disclosure.

Referring to FIGS. 2 to 12, a low-beam zone III lighting module in the basic technical solutions of the present disclosure includes a light source 1, a lens 2, a transparent optical element 3 and a low-beam zone III forming mechanism; and the light source 1, the low-beam zone III forming mechanism, the transparent optical element 3 and the lens 2 are sequentially arranged along a low-beam zone III light shape forming optical path;

The low-beam zone III forming mechanism includes at least one first reflector 4 and at least one second reflector 5, the first reflector 4 and the second reflector 5 are distributed on the two sides of the optical axis of the lens 2 and arranged in a staggered manner, that is, each first reflector 4 is located in front of the corresponding second reflector 5, the second reflector 5 is located behind the transparent optical element 3, the light source 1 is located in the first focal point of the first reflector 4, the second focal point of the first reflector 4 coincides with the first focal point of the second reflector 5, and the second focal point of the second reflector 5 is arranged on the light incident surface 31 of the transparent optical element 3, so that the second reflector 5 is located behind the light incident surface 31 of the transparent optical element 3, and the lens 2 is located directly in front of the light emergent surface 32 of the transparent optical element 3.

It should be noted that the light source 1 is located at the first focal point of the first reflector 4, the second focal point of the first reflector 4 coincides with the first focal point of the second reflector 5, and the second focal point of the second reflector 5 is arranged on the light incident surface 31 of the transparent optical element 3; the reason why the corresponding optical elements are arranged at the focal points is to efficiently use the energy of light, the light at the focal point is most concentrated, that is, in the above technical solutions, it is not indicated that the corresponding optical elements are strictly coincident with the focal points, and a small amount of deviation may be allowed to adjust a lighting light shape and intensity, and the small amount of deviation refers to a distance deviation in the millimeter level, specifically, the small amount of deviation is generally within 5 mm.

It is understandable that there are at least two kinds of low-beam zone III forming mechanisms, one is to include only a first reflector 4 and a second reflector 5, and thus the width on one side of the low-beam zone III light shape can be enlarged; the other is to include two first reflectors 4 and two second reflectors 5, and thus the width of the two sides of the low-beam zone III light shape can be enlarged; in addition, the first reflector 4 and the corresponding second reflector 5 can be arranged facing each other, that is, reflecting surface of the first reflector 4 and reflecting surface of the corresponding second reflector 5 are arranged facing each other, in this way, the light received by the reflecting surface of the first reflector 4 is reflected and then can be emitted to the reflecting surface of the second reflector 5 through the first focal point of the corresponding second reflector 5, and finally a large-angle, wide-range low-beam zone III light shape is formed.

In the above technical solutions, the light emitted by the light source 1 is firstly reflected by the first reflector 4 and emitted from the second focal point of the first reflector 4, since the second focal point of the first reflector 4 and the first focal point of the second reflector 5 coincide, the light is reflected by the second reflector 5 and emitted from the second focal point of the second reflector 5, and the second focal point of the second reflector 5 is arranged on the light incident surface 31 of the transparent optical element 3, so that the light is emitted into the transparent optical element 3, then emitted through the light emergent surface 32 of the transparent optical element 3, and finally emitted through the lens 2 to form a low-beam zone III light shape, wherein due to the relative optical position relationship between the first reflector 4 and the second reflector 5 and in combination with the optical position relationship between the second reflector 5 and the transparent optical element 3, the transmission direction of the light emitted through the lens 2 changes by a certain large angle on the left side or the right side or both sides, so that the illumination range of the low-beam zone III light shape is enlarged on the left side or the right side or both sides, that is, the width of the low-beam zone III light shape is enlarged. Referring to FIGS. 2 to 9, in a specific embodiment of the present disclosure, the transparent optical element 3 includes the light incident surface 31, the light emergent surface 32, an upper surface 33, and a lower surface 34. The light incident surface 31, the upper surface 33, the lower surface 34 and the light emergent surface 32 define a light channel 35. The transparent optical element 3 is made of a transparent material and has high light efficiency, which can make the system composition simple and the system cost low.

Referring to FIGS. 2 to 9, in a preferred embodiment of the present disclosure, the light incident surface 31 may be arranged as a flat surface or a concave or convex cambered surface, which can diffuse light, and the upper surface 33 is arranged as a flat surface or a concave or convex cambered surface, which can reflect light incident from the light incident surface 31. Regarding the shape of the light incident surface 31 and the upper surface 33, those of ordinary skilled in the art may select the shapes of the light incident surface 31 and the upper surface 33 according to design requirements. The light emergent surface 32 is arranged as a cambered surface with a concave middle and two convex ends, so that the angle of outer side light emitted from the light emergent surface 32 of the transparent optical element 3 is more divergent, and large-angle and wide-range low-beam zone III lighting is achieved more advantageously.

In a preferred embodiment, at least one of the light incident surface 31, the upper surface 33 and the light emergent surface 32 is provided with wrinkles. Wherein, the wrinkles are of an irregularly-shaped granular microstructure, and is configured to produce diffuse reflection of light, reduce the energy of light irradiating on the effective area and adjust the lighting intensity of the low-beam zone III so as to meet the regulatory requirements (general regulations require the maximum lighting intensity of the zone III to be lower than 625 cd) of headlights.

Figure 11:
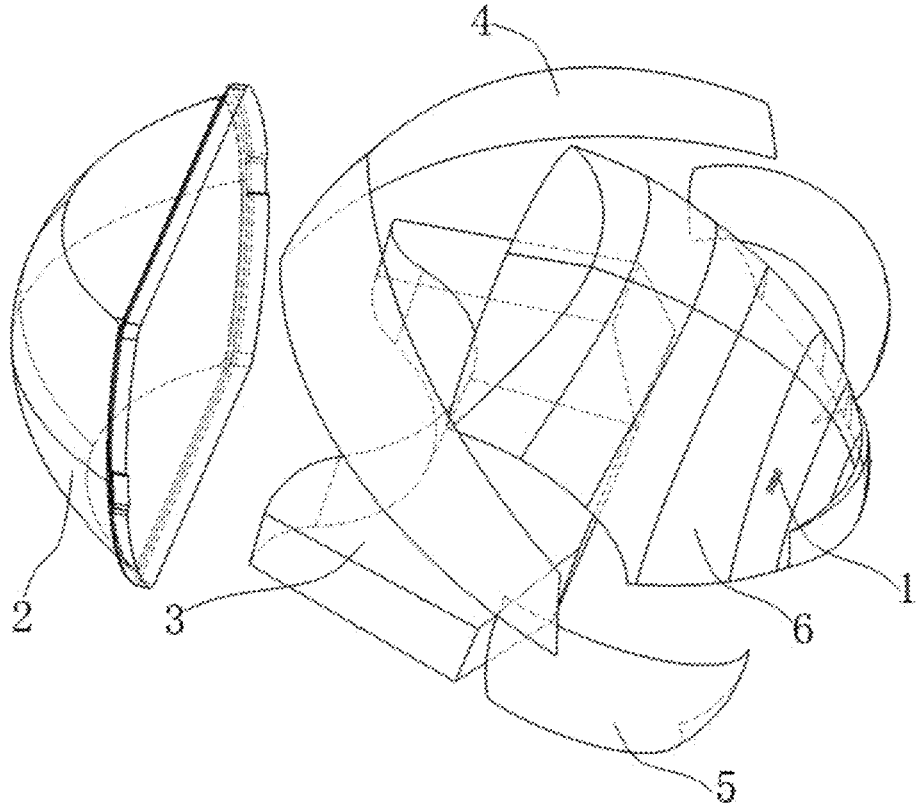
FIG. 11 is a schematic diagram of a three-dimensional structure of another embodiment of the present disclosure.
Figure 12:
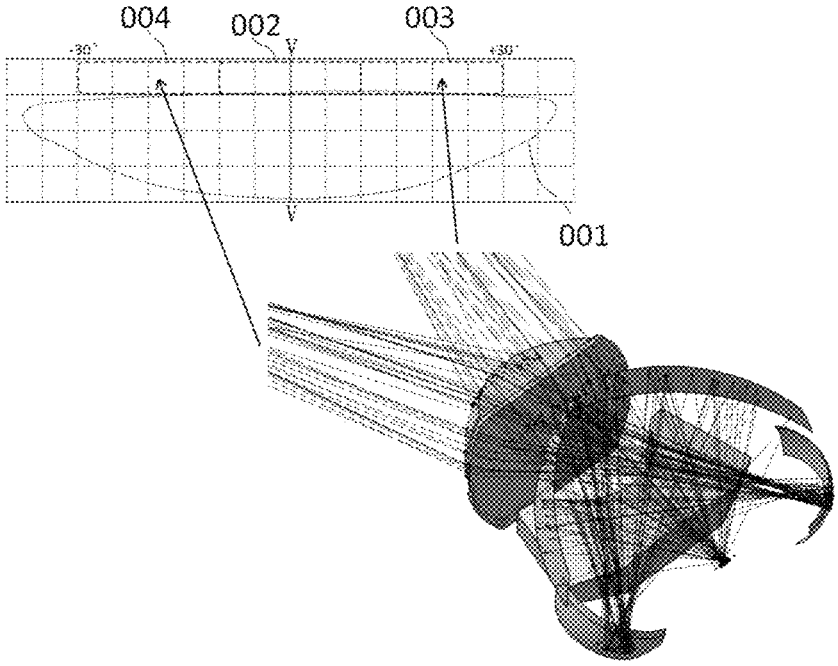
FIG. 12 is a light direction diagram and a light pattern diagram of FIG. 11.

In a specific embodiment, the first reflector 4 and the second reflector 5 are configured as ellipsoidal reflectors. It is understandable that in specific embodiments, the characteristics of the ellipsoidal reflector are mainly used: light emitted from or passing through any focal point is converged to another focal point after passing through the ellipsoidal reflector; moreover, those skilled in the art should be conceivable that the first reflector 4 and the second reflector 5 can also adopt vehicle light reflectors capable of realizing the above functions in the prior art, such as bifocal parabolic reflectors, as long as light emitted from or passing through any one of the focal points of the reflector is converged to the other focal point after passing through the reflector. Referring to FIGS. 2 to 10, in a preferred embodiment of the present disclosure, the low-beam zone III forming mechanism may include a first reflector 4 and a second reflector 5. The first reflector 4 and the second reflector 5 are distributed on the two sides of the optical axis of the lens 2 and arranged in a staggered manner, that is, the first reflector 4 is located in front of the second reflector 5, the second reflector 5 is located behind the transparent optical element 3, the light source 1 is located at the first focal point of the first reflector 4, the second focal point of the first reflector 4 coincides with the first focal point of the second reflector 5, the second focal point of the second reflector 5 is arranged on the light incident surface 31 of the transparent optical element 3, the lens 2 is located directly in front of the light emergent surface 32 of the transparent optical element 3, thus the light emitted by the light source 1 can achieve the effect of expanding the width of the low-beam zone III light shape on one side through the optical path composed of the first reflector 4, the second reflector 5 and the transparent optical element 3. Referring to FIG. 11 and FIG. 12, in another preferred embodiment of the present disclosure, the low-beam zone III forming mechanism may include two first reflectors 4 and two second reflectors 5. The two first reflectors 4 and the two second reflectors 5 are arranged symmetrically on the two sides of the optical axis of the lens 2, respectively, wherein the second focal point of the first reflector 4 located on one side of the optical axis of the lens 2 coincides with the first focal point of the second reflector 5 located on the other side of the optical axis of the lens 2, the first reflector 4 are located in front of the corresponding second reflector 5, the first focal points of the two first reflectors 4 coincide, the light source 1 is located at the first focal point of the first reflector 4, the second focal point of each of the second reflectors 5 is arranged on the light incident surface 31 of the transparent optical element 3, the lens 2 is located directly in front of the light emergent surface 32 of the transparent optical element 3, thus, the light emitted by the light source 1 may pass through the optical path composed of the first reflectors 4, the second reflectors 5 and the transparent optical element 3 and then is emitted by the lens 2, a large-angle and wide-range zone III light shape in the left-right direction is obtained, and accordingly the purpose of expanding the width of the low-beam zone III light shape on the two sides is achieved.

Figure 3:
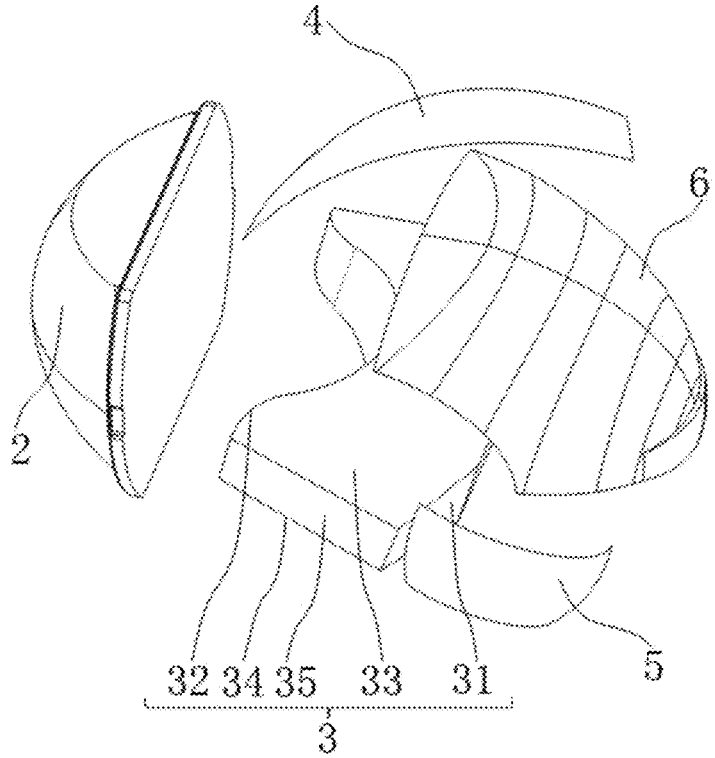
FIG. 3 is another schematic diagram of a three-dimensional structure of an embodiment of the present disclosure.
Figure 4:
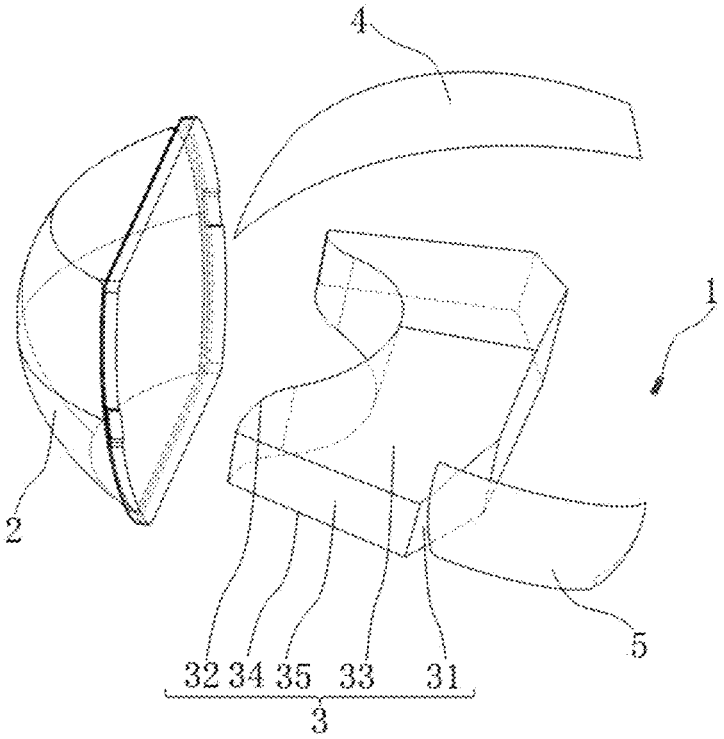
FIG. 4 is a schematic diagram of a three-dimensional structure of another embodiment of the present disclosure.
Figure 5:
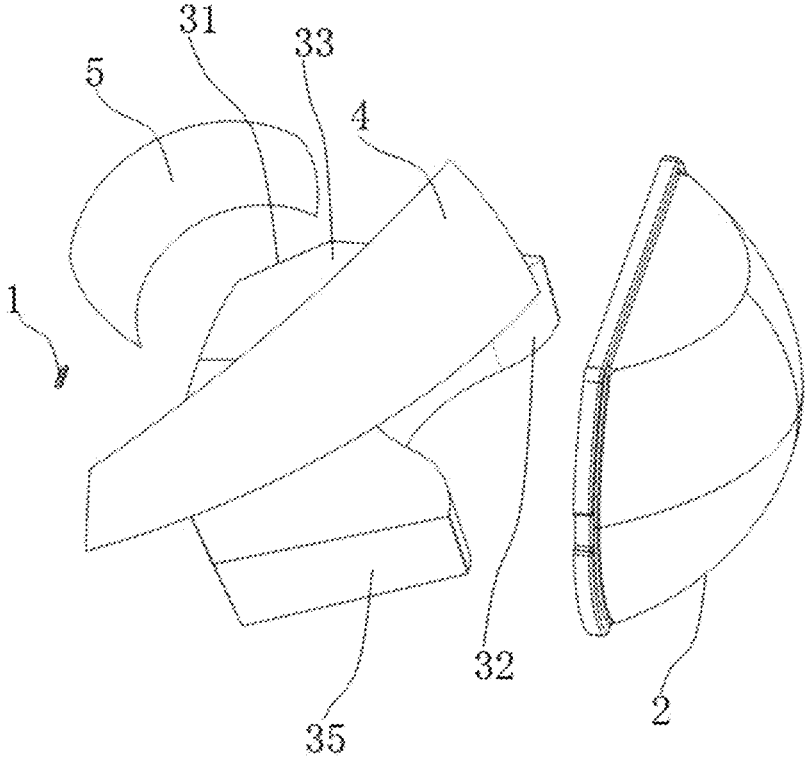
FIG. 5 is a schematic diagram of a three-dimensional structure of yet another embodiment of the present disclosure.
Figure 6:
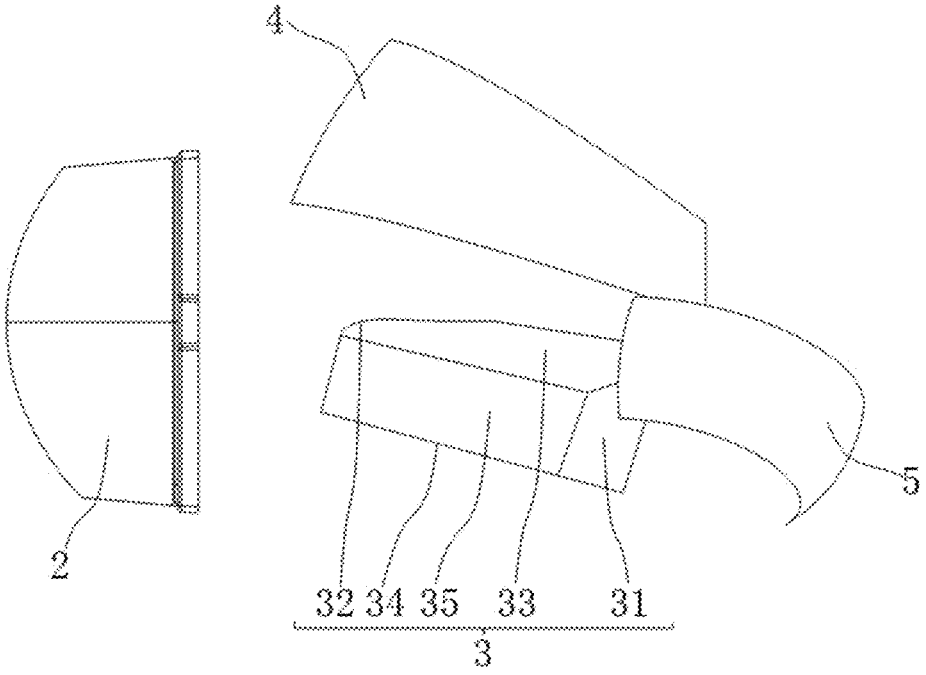
FIG. 6 is a side view of the structure in FIG. 4.
Figure 7:
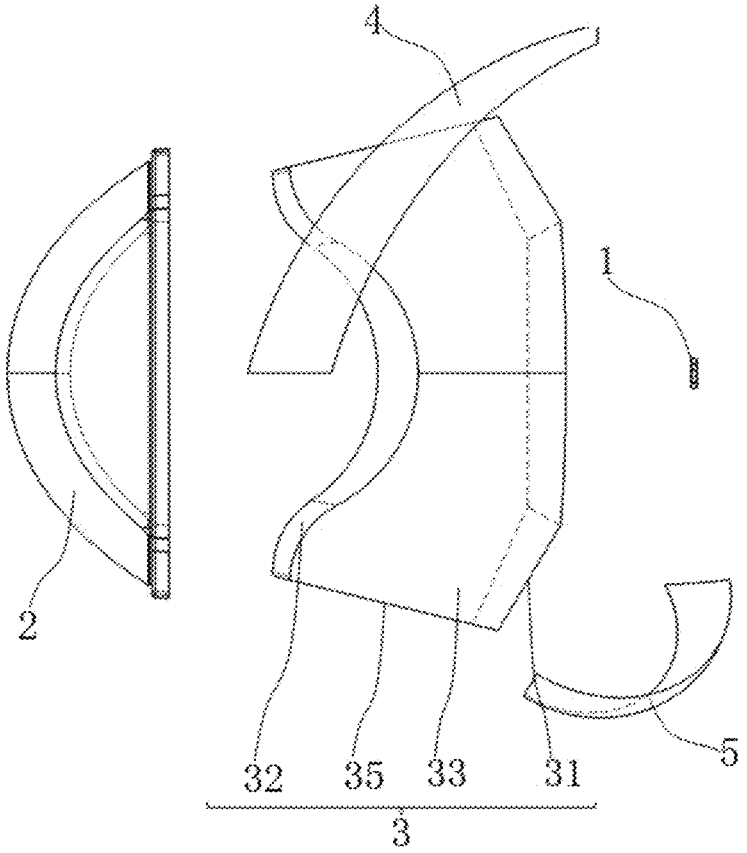
FIG. 7 is a top view of the structure in FIG. 4.
Figure 8:
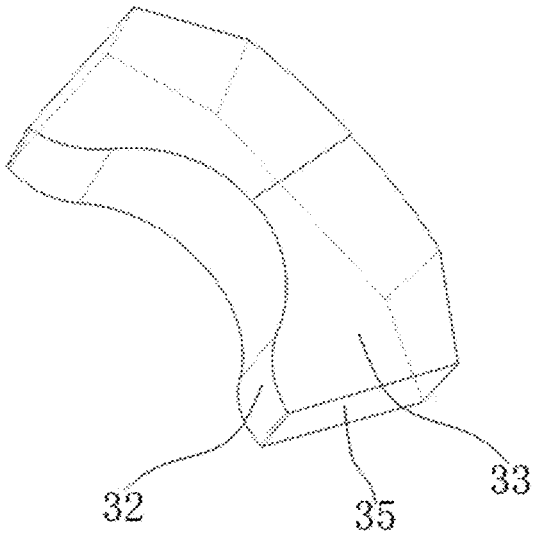
FIG. 8 is a schematic view of a three-dimensional structure of the transparent optical element in the present disclosure.
Figure 9:
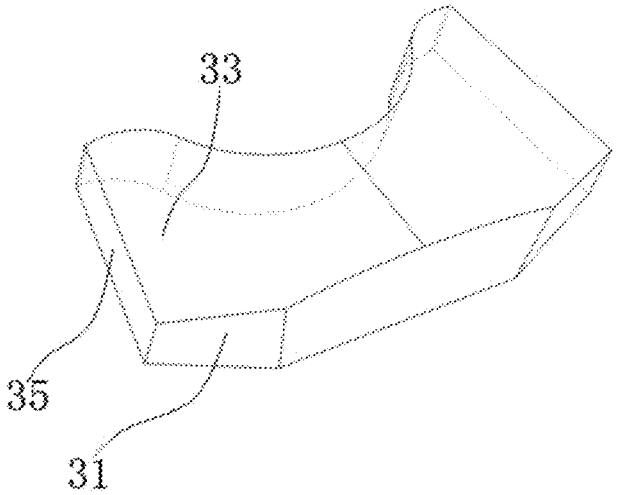
FIG. 9 is another schematic diagram of a three-dimensional structure of the transparent optical element in the present disclosure.

Referring to FIG. 2, FIG. 3, and FIG. 10 to 12, those of ordinary skilled in the art can integrate an optical module of the low-beam main body light shape similar to that shown in FIG. 2, FIG. 3 and FIG. 11 for lighting of vehicle headlamps based on the above technical solutions typically. Specifically, a low-beam reflector 6 may be arranged in the above technical solution, and thus a first focal point of the low-beam reflector 6 is arranged on the light source 1. In this way, a low-beam light shape 001 and a large-angle and wide-range zone III light shape can be obtained simultaneously. In addition, a cut-off line forming structure can be directly arranged at the upper boundary of the light emergent surface 32 of the transparent optical element 3 so that the low-beam light pattern 001 with the cut-off line can be formed; and certainly, other methods for forming the cut-off line can also be adopted.

Typically, a radiator may also be included, thus, each of the first reflectors 4, each of the second reflectors 5 and the low-beam reflector 6 may be mounted on the radiator, or be integrally formed with the radiator, and production and assembly are facilitated.

Referring to FIGS. 2 to 12, the low-beam zone III lighting module of the preferred embodiment of the present disclosure includes a light source 1, a lens 2, a transparent optical element 3 and a low-beam zone III forming mechanism; the light source 1, the low-beam zone III forming mechanism, the transparent optical element 3 and the lens 2 are sequentially arranged along the low-beam zone III light shape forming optical path; the low-beam zone III forming mechanism includes at least one first reflector 4 and at least one second reflector 5, it should be understood that the low-beam zone III forming mechanism is arranged in at least two forms, the first low-beam zone III forming mechanism includes only a first reflector 4 and a second reflector 5, the first reflector 4 and the second reflector 5 are distributed on the two sides of the optical axis of the lens 2 and arranged in a staggered manner, that is, the first reflector 4 is located in front of the corresponding second reflector 5, the light source 1 is located at the first focal point of the first reflector 4, the second focal point of the first reflector 4 coincides with the first focal point of the second reflector 5, the second focal point of the second reflector 5 is arranged on the light incident surface 31 of the transparent optical element 3, and the lens 2 is located directly in front of the light emergent surface 32 of the transparent optical element 3; or the low-beam zone III forming mechanism includes two first reflectors 4 and two second reflectors 5, the two first reflectors 4 and the two second reflectors 5 are symmetrically arranged on the two sides of the optical axis of the lens 2, respectively, wherein the second focal point of the first reflector 4 located on one side of the optical axis of the lens 2 and the first focal point of the second reflector 5 located on the other side of the optical axis of the lens 2 coincide, the first reflector 4 are located in front of the corresponding second reflector 5, the first focal points of the two first reflectors 4 coincide, the light source 1 is located at the first focal points of the first reflectors 4, and the second focal point of each of the second reflectors 5 is arranged on the light incident surface 31 of the transparent optical element 3; through the above arrangement, the first reflectors 4, the second reflectors 5 and the transparent optical element 3 form an optical path capable of obtaining a large-angle and wide-range zone III light shape, and the effect of expanding the width of the light shape of a low-beam zone III in the left-right direction is achieved, wherein the first reflectors 4 and the second reflectors 5 may be ellipsoidal reflectors; in addition, the light incident surface 31 of the transparent optical element 3 may be arranged as a flat surface or a concave or convex cambered surface, which can diffuse light, the upper surface 33 of the transparent optical element 3 may be arranged as a flat surface or a concave or convex cambered surface, which can reflect the light incident from the light incident surface 31, the light emergent surface 32 may be arranged as a cambered surface with a concave middle and two convex ends, so that the angle of outer side light emitted from the light emergent surface 32 of the transparent optical element 3 is more divergent, and a large-angle and wide-range low-beam zone III light shape is formed more advantageously; further, one or more of the light incident surface 31, the upper surface 33 and the light emergent surface 32 may be provided with wrinkles, the characteristic of producing diffuse reflection on light by the wrinkles are utilized, the lighting intensity of the low-beam zone III is adjusted, the energy of light irradiated on the effective area is reduced, and the regulatory requirements of headlights are met; moreover, the technical means in the field can further be combined, a low-beam reflector 6, a radiator and the like can be additionally arranged, the low-beam reflector 6 enables a module to produce a low-beam light pattern 001, the radiator can be detachably installed with the first reflector 4, the second reflector 5 and the low-beam reflector 6, or be integrally formed with the first reflector 4, the second reflector 5 and the low-beam reflector 6 according to the design needs, production and assembly are facilitated, and various types of radiators such as air-cooled radiators, water-cooled radiators and heat pipe radiators may be adopted.

Referring to FIGS. 2 to 12, the working process of the low-beam zone III lighting module of the present disclosure is described.

Light emitted by the light source 1 is firstly reflected by the first reflector 4 and emitted from the second focal point of the first reflector 4, since the second focal point of the first reflector 4 coincides with the first focal point of the second reflector 5, the light is then reflected by the second reflector 5 and emitted from the second focal point of the second reflector 5, the second focal point of the second reflector 5 is arranged on the light incident surface 31 of the transparent optical element 3, thus, the light is emitted into the transparent optical element 3, a part of the light is reflected by the upper surface 33 and then irradiated to the light emergent surface 32, another part of the light is directly irradiated to the light emergent surface 32 through the light channel 35, and the light is emitted through the light emergent surface 32 of the transparent optical element 3 and finally emitted through the lens 2 to form the low-beam zone III light shape; due to the relative optical position relationship between the first reflector 4 and the second reflector 5 and in combination with the optical position relationship between the second reflector 5 and the transparent optical element 3, the transmission direction of the light emitted through the lens 2 is changed by a certain large angle on the left side or the right side or both sides, so that the lighting range of the low-beam zone III light shape on the left side or the right side or both sides is enlarged, that is, the width of the low-beam zone III light shape is increased; wherein one or more surfaces of the light incident surface 31, the upper surface 33 and the light emergent surface 32 are provided with wrinkles, the characteristic of producing diffuse reflection on light by the wrinkles is utilized, the lighting intensity of the low-beam zone III can be adjusted, the energy of light irradiated on the effective area is reduced, and the regulatory requirements of vehicle lights are met; and in addition, the low-beam reflector 6 can be arranged, the first focal point of the low-beam reflector 6 is located on the light source 1, in this way, the light reflected by the low-beam reflector 6 can emit to form a low-beam light pattern 001.

Figure 1:
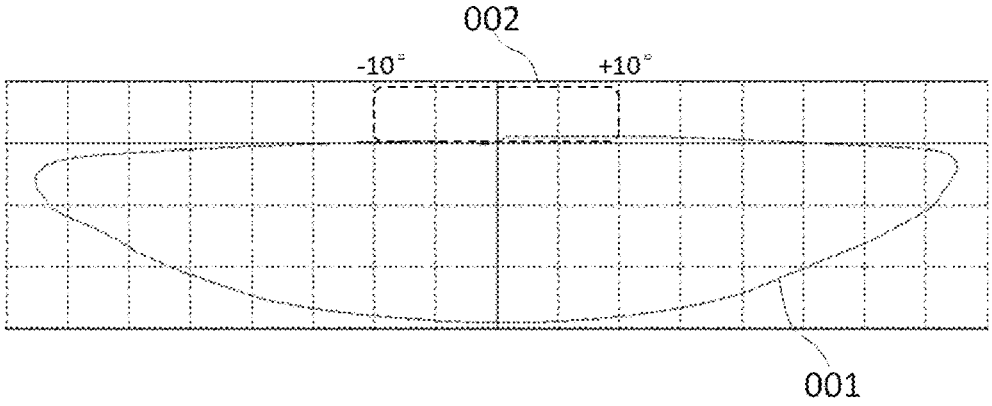
FIG. 1 is a schematic diagram of a low-beam light pattern in the prior art.
Figure 10:
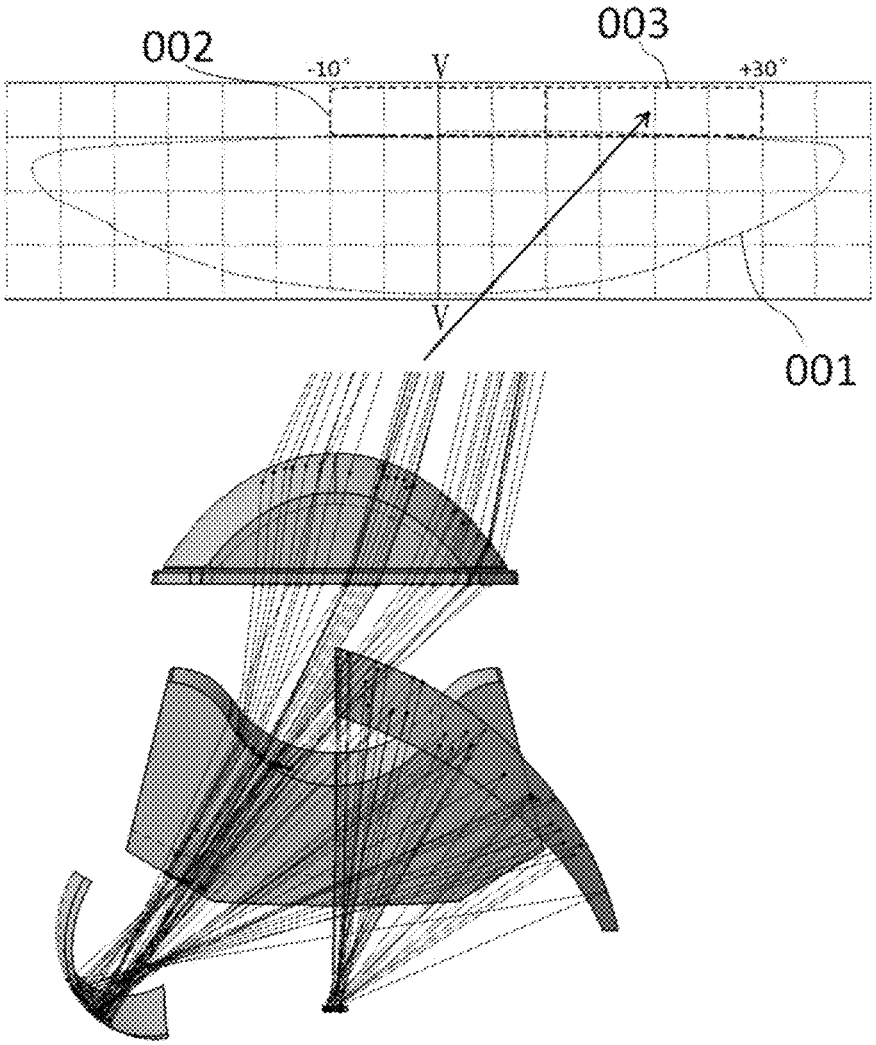
FIG. 10 is a light direction diagram and a schematic light shape diagram according to an embodiment of the present disclosure.

It should be noted that, as shown in FIG. 1, the lighting range of a zone III formed in the prior art is shown as a small-angle zone III light pattern 002, which is generally ±10 degrees in the left and right directions; however, referring to FIGS. 10 and 12, it can be known that in the technical solutions of the present disclosure, the zone III light shape is large in angle and wide in range compared with that in the prior art, it can be seen from FIG. 10 that an embodiment of the present disclosure achieves a large-angle zone III lighting range of 10 degrees on the left and 30 degrees on the right, referring to FIG. 10 showing a right large-angle zone III light shape 003, but it is not indicated here that the angle of the corresponding zone III is strictly 30 degrees, the degree in the drawing is only a schematic illustration of the large-angle and wide-range zone III light shape in the left-right direction, and it may be understood that other possibilities are also included, such as an angle being greater than 30 degrees; in addition, a case where the zone III light shape are large in angle and wide in range on the left and right sides of the embodiment shown in FIG. 12 can be further obtained, referring to FIG. 12 showing a left large-angle zone III light shape 004 and a right large-angle zone III light shape 003, moreover, the left side angle and the right side angle do not have to be equal and can be designed according to the design needs; wherein the angles are measured relative to the 0 degree position of the V-V axis, and the position of the low-beam V-V axis is a common sense of those skilled in the art and is a vertical axis passing through the turning point of the low-beam cut-off line.

The embodiments of the vehicle headlamp of the present disclosure may be provided with the low-beam zone III lighting module described in any one of the above embodiments, namely all the technical solutions of all the above embodiments of the low-beam zone III lighting module are adopted, so that the vehicle headlamp at least has all the beneficial effects brought by the technical solutions of the embodiments of the above low-beam zone III lighting module; and the low-beam zone III lighting module and the vehicle headlamp of the present disclosure are particularly applicable to low-beam zone III lighting of AFS headlights.

When the low-beam zone III lighting module is applied to the vehicle headlamp, the first reflector 4, the second reflector 5 and the low-beam reflector 6 can be integrally formed with the radiator, so that production and assembly are facilitated.

Further, the low-beam zone III lighting module of the present disclosure is applied to an AFS vehicle headlamp, so that when a vehicle turns, good zone III lighting within the turning range can still be achieved while a low-beam cut-off part shifts left and right and a zone III lightshape does not shift.

A vehicle of the present disclosure may be provided with the vehicle headlamp described in the above embodiments, and at least has all the beneficial effects brought by the technical solutions of the above embodiments of the vehicle headlamp.

It should be understood that the above vehicle headlamp is applied to the vehicle, that is, the low-beam zone III lighting module of the present disclosure is applied to the vehicle, especially a headlight with AFS functions; and when the vehicle turns, good zone III lighting within the turning range can still be achieved while the low-beam cut-off part shift left and right and the zone III light shape does not shift, and thus a driver can better obtain road surface information such as signs.

In the description of the present disclosure, the description with reference to the terms "specific embodiments", "preferred embodiments", "a preferred embodiment" and the like means that the specific features, structures, materials or characteristics described in conjunction with the embodiments or examples are included in at least one embodiment or example of the present disclosure. In the present disclosure, the schematic expressions of the above terms do not necessarily refer to the same embodiment or example. Moreover, the described specific features, structures, materials or characteristics may be combined in a suitable manner in any one or more embodiments or examples.

The preferred implementations of the present disclosure have been described in detail above with reference to the accompanying drawings, but the present disclosure is not limited thereto. Within the scope of the technical idea of the present disclosure, a variety of simple modifications can be made to the technical solutions of the present disclosure, including the combination of individual specific technical features in any suitable manner. In order to avoid unnecessary repetition, various possible combination ways are not described separately in the present disclosure. However, the simple modifications and combinations should also be regarded as the content disclosed by the present disclosure, and all fall within the protection scope of the present disclosure.

The invention claimed is:

1. A low-beam zone III lighting module, comprising a light source and a lens, wherein the low-beam zone III lighting module further comprises a transparent optical element and a low-beam zone III forming mechanism; the light source, the low-beam zone III forming mechanism, the transparent optical element and the lens are sequentially arranged along a low-beam zone III light shape forming optical path; and the low-beam zone III forming mechanism comprises at least one first reflector and at least one second reflector, the first reflector and the second reflector are distributed on two sides of an optical axis of the lens and arranged in a staggered manner, the light source is located at a first focal point of the first reflector, a second focal point of the first reflector and a first focal point of the second reflector coincide, a second focal point of the second reflector is arranged on a light incident surface of the transparent optical element, and the lens is located directly in front of a light emergent surface of the transparent optical element.

2. The low-beam zone III lighting module according to claim 1, wherein the transparent optical element comprises the light incident surface, the light emergent surface, an upper surface and a lower surface, and the light incident surface, the upper surface, the lower surface and the light emergent surface define a light channel.

3. The low-beam zone III lighting module according to claim 2, wherein the light incident surface is arranged as a flat surface or a concave or convex cambered surface, the upper surface is arranged as a flat surface or a concave or convex cambered surface, and the light emergent surface is arranged as a cambered surface with a concave middle and two convex ends.

4. The low-beam zone III lighting module according to claim 2, wherein at least one of the light incident surface, the upper surface and the light emergent surface is provided with wrinkles.

5. The low-beam zone III lighting module according to claim 1, wherein the first reflector and the second reflector are configured to be ellipsoidal reflectors.

6. The low-beam zone III lighting module according to claim 1, wherein the low-beam zone III forming mechanism comprises one first reflector and one second reflector, the first reflector and the second reflector are respectively distributed on the two sides of the optical axis of the lens and arranged in a staggered manner, the light source is located at the first focal point of the first reflector, the second focal point of the first reflector and the first focal point of the second reflector coincide, the second focal point of the second reflector is arranged on the light incident surface of the transparent optical element, the lens is located directly in front of the light emergent surface of the transparent optical element, so as to enlarge the width of one side of the low-beam zone III light shape.

7. The low-beam zone III lighting module according to claim 1, wherein the low-beam zone III forming mechanism comprises two first reflectors and two second reflectors, the two first reflectors and the two second reflectors are arranged symmetrically on the two sides of the optical axis of the lens respectively, the second focal point of the first reflector located on one side of the optical axis of the lens and the first focal point of the second reflector located on the other side of the optical axis of the lens coincide, the first focal points of the two first reflectors coincide, the light source is located at the first focal points of the first reflectors, the second focal points of each of the second reflectors is arranged on the light incident surface of the transparent optical element, the lens is located directly in front of the light emergent surface of the transparent optical element, so as to enlarge the widths of two sides of the low-beam zone III light.

8. The low-beam zone III lighting module according to claim 1, wherein further comprising a low-beam reflector, a first focal point of the low-beam reflector is arranged on the light source.

9. The low-beam zone III lighting module according to claim 8, wherein further comprising a radiator, each of the first reflectors, each of the second reflectors and the low-beam reflector are mounted on the radiator or integrally formed with the radiator.

10. A vehicle headlamp comprising the low-beam zone III lighting module according to claim 1.

11. A vehicle comprising the vehicle headlamp according to claim 10.

12. The vehicle headlamp according to claim 10, wherein the transparent optical element comprises the light incident surface, the light emergent surface, an upper surface and a lower surface, and the light incident surface, the upper surface, the lower surface and the light emergent surface define a light channel.

13. The vehicle headlamp according to claim 12, wherein the light incident surface is arranged as a flat surface or a concave or convex cambered surface, the upper surface is arranged as a flat surface or a concave or convex cambered surface, and the light emergent surface is arranged as a cambered surface with a concave middle and two convex ends.

14. The vehicle headlamp according to claim 12, wherein at least one of the light incident surface, the upper surface and the light emergent surface is provided with wrinkles.

15. The vehicle headlamp according to claim 10, wherein the first reflector and the second reflector are configured to be ellipsoidal reflectors.

16. The vehicle headlamp according to claim 10, wherein the low-beam zone III forming mechanism comprises one first reflector and one second reflector, the first reflector and the second reflector are respectively distributed on the two sides of the optical axis of the lens and arranged in a staggered manner, the light source is located at the first focal point of the first reflector, the second focal point of the first reflector and the first focal point of the second reflector coincide, the second focal point of the second reflector is arranged on the light incident surface of the transparent optical element, the lens is located directly in front of the light emergent surface of the transparent optical element, so as to enlarge the width of one side of the low-beam zone III light shape.

17. The vehicle headlamp according to claim 10, wherein the low-beam zone III forming mechanism comprises two first reflectors and two second reflectors, the two first reflectors and the two second reflectors are arranged symmetrically on the two sides of the optical axis of the lens respectively, the second focal point of the first reflector located on one side of the optical axis of the lens and the first focal point of the second reflector located on the other side of the optical axis of the lens coincide, the first focal points of the two first reflectors coincide, the light source is located at the first focal points of the first reflectors, the second focal points of each of the second reflectors is arranged on the light incident surface of the transparent optical element, the lens is located directly in front of the light emergent surface of the transparent optical element, so as to enlarge the widths of two sides of the low-beam zone III light.

18. The vehicle headlamp according to claim 10 further comprising a low-beam reflector, a first focal point of the low-beam reflector is arranged on the light source.

19. The vehicle headlamp according to claim 18 further comprising a radiator, each of the first reflectors, each of the second reflectors and the low-beam reflector are mounted on the radiator or integrally formed with the radiator.

* * * * *